US008607850B2

(12) United States Patent
Kappes et al.

(10) Patent No.: US 8,607,850 B2
(45) Date of Patent: Dec. 17, 2013

(54) METHOD FOR PROCESSING A MINERAL ORE SLURRY

(75) Inventors: Daniel W. Kappes, Reno, NV (US); Dustin J. Albin, Reno, NV (US)

(73) Assignee: Kappes, Cassiday & Associates, Reno, NV (US)

( * ) Notice: Subject to any disclaimer, the term of this patent is extended or adjusted under 35 U.S.C. 154(b) by 187 days.

(21) Appl. No.: 13/249,075

(22) Filed: Sep. 29, 2011

(65) Prior Publication Data

US 2012/0018124 A1 Jan. 26, 2012

Related U.S. Application Data

(62) Division of application No. 12/625,237, filed on Nov. 24, 2009, now Pat. No. 8,051,902.

(51) Int. Cl.
*F28D 7/16* (2006.01)

(52) U.S. Cl.
USPC ..... 165/164; 210/741; 210/175

(58) Field of Classification Search
USPC ..... 165/164, 4; 210/737, 741, 175
See application file for complete search history.

(56) References Cited

U.S. PATENT DOCUMENTS

| | | | | |
|---|---|---|---|---|
| 828,807 | A | 8/1906 | Bolton | |
| 1,571,068 | A | 1/1926 | Stancliffe | |
| 1,799,626 | A | 4/1931 | Keith, Jr. | |
| 2,401,797 | A | 6/1946 | Rasmussen | |
| 3,272,260 | A | 9/1966 | Raub et al. | |
| 3,444,924 | A | 5/1969 | Lustenader | |
| 3,595,310 | A | 7/1971 | Burne et al. | |
| 3,693,711 | A | 9/1972 | Zygiel | |
| 3,907,026 | A | 9/1975 | Mangus | |
| 3,999,602 | A | 12/1976 | Fewell et al. | |
| 4,156,625 | A * | 5/1979 | Wachendorfer, Sr. | 165/164 |
| 4,252,752 | A | 2/1981 | Flandroy | |

(Continued)

FOREIGN PATENT DOCUMENTS

| | | | |
|---|---|---|---|
| CA | 2761604 | C | 9/2012 |
| DE | 1105894 | A | 5/1961 |
| DE | 1105894 | B | 5/1961 |
| DE | 2541424 | A1 | 3/1977 |
| FR | 2889582 | A1 | 2/2007 |

OTHER PUBLICATIONS

International Search Report and Written Opinion for corresponding International Patent Application No. PCT/US2010/046668, filed Aug. 25, 2010.

(Continued)

*Primary Examiner* — Teresa Walberg
(74) *Attorney, Agent, or Firm* — Lewis Roca Rothberger LLP

(57) ABSTRACT

A heat exchanger includes a heat-exchange section including a first group of tubes and a second group of tubes alternating with the first group of tubes. The first and second groups of tubes are in contact with a heat-conductive medium. In one structure, a first inlet manifold at a first end of the heat-exchange section is fluidly coupled to first ends of the first group of tubes. A first outlet manifold is isolated from the first inlet manifold and is fluidly coupled to first ends of the second group of tubes. A second inlet manifold at a second end of the heat-exchange section is fluidly coupled to second ends of the second group of tubes. A second outlet manifold is isolated from the second inlet manifold and is fluidly coupled to second ends of the first group of tubes.

2 Claims, 3 Drawing Sheets

(56) References Cited

U.S. PATENT DOCUMENTS

| | | | | |
|---|---|---|---|---|
| 4,711,298 | A | 12/1987 | Rogier et al. | |
| 4,782,892 | A | 11/1988 | Ostbo | |
| 5,139,650 | A | 8/1992 | Lenglet | |
| 5,242,015 | A | 9/1993 | Saperstein et al. | |
| 5,285,845 | A | 2/1994 | Ostbo | |
| 5,980,838 | A | 11/1999 | von Hippel et al. | |
| 6,355,145 | B1 * | 3/2002 | Kresnyak et al. | 203/1 |
| 6,626,235 | B1 | 9/2003 | Christie | |
| 6,896,043 | B2 | 5/2005 | Dunn | |
| 7,285,153 | B2 | 10/2007 | Bruun et al. | |
| 8,051,902 | B2 | 11/2011 | Kappes et al. | |
| 2005/0028964 | A1 | 2/2005 | Cleland | |
| 2011/0080035 | A1 * | 4/2011 | Bishop | 299/4 |

OTHER PUBLICATIONS

Extended European Search Report in corresponding European Patent Application No. 10833715.5, entitled Solid Matrix Tube-to-Tube Heat Exchanger, dated Feb. 21, 2013, 7 pages.

Notification Concerning Transmittal of International Preliminary Report on Patentability, mailed Jun. 7, 2012, in PCT/US2010/046668 filed Nov. 24, 2009.

International Preliminary Report on Patentability, dated May 30, 2012 and mailed Jun. 7, 2012, in PCT/US2010/046668 filed Nov. 24, 2009.

* cited by examiner

METHOD FOR PROCESSING A MINERAL ORE SLURRY

CROSS-REFERENCE TO RELATED APPLICATIONS

This application is a divisional of co-pending U.S. patent application Ser. No. 12/625,237, filed Nov. 24, 2009, the entirety of which is incorporated by reference herein.

BACKGROUND

1. Field of the Invention

The present invention relates to heat exchangers and in particular to the transfer of heat from one liquid, such as a slurry, to another.

2. The Prior Art

A heat exchanger is a device used to transfer heat from one medium to another. In industries such as the mining industry there are many processes that require heating a mineral-ore slurry. A slurry is a suspension of solid particles in a fluid. Slurries contain solid particles that have a tendency to settle. Some slurries also have a tendency to create scale. Both of these issues complicate performing heat-exchange processes, due to the need to periodically clean heat-transfer and other apparatus used in slurry processing The high cost of energy makes heat exchangers crucial to the feasibility of these processes. Currently there are no heat exchangers on the market that meet this need. As a result, when it is necessary to heat a mineral-ore slurry in a countercurrent manner (by cooling another slurry passing in the opposite direction), very complex systems are used, such as contact heat exchangers in which steam is evolved from one slurry and absorbed into the other slurry in an adjacent manifold. This is the typical type of exchanger used in Bayer Process plants for producing alumina from Bauxite ore.

Slurries have been run through existing heat exchanger configurations such as spiral or plate heat exchangers. A spiral exchanger includes a pair of flat surfaces that are coiled to form two channels in a counter current arrangement with each channel having a long curved path. A plate exchanger is composed of multiple, thin, slightly separated plates that have very large surface areas and fluid passages for heat transfer.

Although spiral and plate exchangers are promoted as being able to handle slurries, they employ fluid passages having physical dimensions that are typically not conducive to maintaining a good suspension of solids in the slurry. Spiral and plate exchangers do not have easily accessible passages and in some cases have no access at all, leading to high maintenance costs. Spiral and plate exchangers can be used in some slurry applications, but in fact they can be used only for relatively simple and dilute slurries in which the slurry particles stay easily suspended in the liquid.

Shell-and-tube exchangers are currently used in some slurry applications as well. A shell and tube exchanger consists of a series of tubes running through a shell and containing a medium to be either heated or cooled. The shell (or larger tube) contains a second flowing medium which either provides or absorbs the heat as required.

Currently it is possible to heat a slurry in the tube side of a shell-and-tube exchanger in which the shell contains a non slurry (liquid or steam), but it is not possible to transfer heat from a slurry to a slurry, because the slurry cannot be run in the shell side, where large particles will settle out, causing fouling and eventually blockage.

In the 1990's, several plants that processed nickel ore were installed in Australia, all using high temperature autoclaves.

Extensive research was done for the design of these plants in order to select an effective heat exchanger. However, the best system which was found was a system in which steam was extracted by a slight vacuum from the slurry and then recondensed in the shell of a shell and tube exchanger to heat the slurry passing in the opposite direction. Although these Nickel plants involved a combined capital investment of over US $1 Billion, the designers were not able to find a better way to transfer heat because there existed no design for a simple countercurrent exchanger which could transmit heat from one slurry to another. These complex heat exchange systems recycle only about 70 percent of the heat, representing a missed opportunity to significantly reduce operating costs.

Graphite block heat exchangers are also known in the art. In these exchangers graphite blocks are drilled with several closely spaced parallel holes for carrying the solution to be heated (or cooled), and other holes are drilled at right angles to them to carry the heating (or cooling) fluid. Such exchangers are widely used for heating and cooling acids. However they are limited in their usefulness for several reasons: graphite is soft and cannot be used for abrasive slurries; graphite can be oxidized and so is not chemically stable for some applications; graphite is brittle and has low strength, so the pressure at which these exchangers can operate is limited (high pressure causes cracks to form and propagate from tube to tube). Also, because of the brittleness of the graphite it is difficult to establish a tube header on the ends so that a simple straight-flowpath parallel tube arrangement is not possible. To avoid this problem, graphite exchangers are designed with a cross-flow tube arrangement but this is not nearly as effective as a parallel flow arrangement.

Similar exchangers using other materials substituted for graphite have not been encountered. The main reason would seem to be that drilling or otherwise machining blocks formed from materials such as metal is expensive. An example of such an exchanger is disclosed in U.S. Pat. No. 1,799,626, disclosing tubes cast in a metal block. The tubing would not be effective in accomplishing countercurrent heating/cooling. Similarly, as shown in U.S. Pat. No. 4,711,298, ceramic block exchangers (similar to the graphite block exchangers) are known, but ceramic material also has the brittle qualities of graphite so the tubing arrangements are not simple enough for slurries. The inability of the existing technology to serve the needs of industries such as the mining industry is confirmed by the fact that a need exists, but there are no simple heat exchangers to serve that need.

SUMMARY OF THE INVENTION

According to a first embodiment of the present invention, a heat exchanger includes a heat-exchange section including a plurality of parallel substantially straight tubes in a close-spaced geometrical pattern in contact with a solid heat-conductive medium, including a first group of tubes and a second group of tubes alternating with the first group of tubes. The first and second groups of tubes are in contact with a heat-conductive medium and are thermally coupled to one another via the heat-conductive medium. In some embodiments of the invention, the first and second groups of tubes are embedded in a heat-conductive matrix. In one embodiment of the invention, the exchanger looks like a shell and tube heat exchanger, only the fouling shell side is replaced with a solid matrix of heat conductive material. A fluid, such as a slurry, to be either heated or cooled is flowed through the first group of the tubes (e.g., one half of the tubes) in a first direction. A second fluid is flowed through the second group of tubes in the opposite direction of the flow of the first fluid. The second fluid either provides or absorbs the heat required. The first and second groups of tubes are in contact with a heat-conductive medium and are thermally coupled to one another via the heat-conductive medium. In some embodiments of the invention, the first and second groups of tubes are embedded in a heat-conductive matrix. In one embodiment of the invention, the exchanger looks like a shell and tube heat exchanger, only the fouling shell side is replaced with a solid matrix of heat conductive material. A fluid, such as a slurry, to be either heated or cooled is flowed through the first group of the tubes (e.g., one half of the tubes) in a first direction. A second fluid is flowed through the second group of tubes in the opposite direction of the flow of the first fluid. The second fluid either provides or absorbs the heat required.

The first and second groups of tubes are in contact with a heat-conductive medium and are thermally coupled to one another via the heat-conductive medium. In some embodiments of the invention, the first and second groups of tubes are embedded in a heat-conductive matrix. In one embodiment of the invention, the exchanger looks like a shell and tube heat exchanger, only the fouling shell side is replaced with a solid matrix of heat conductive material. A fluid, such as a slurry, to be either heated or cooled is flowed through the first group of the tubes (e.g., one half of the tubes) in a first direction. A second fluid is flowed through the second group of tubes in the opposite direction of the flow of the first fluid. The second fluid either provides or absorbs the heat required.

A second inlet manifold is disposed at a second end of the heat-exchange section and is fluidly coupled to second ends of the second group of tubes. The second inlet manifold is fluidly coupled to a second inlet. A second outlet manifold is disposed at the second end of the heat-exchange section and is isolated from the second inlet manifold. The second outlet manifold is fluidly coupled to second ends of the first group of tubes. The second outlet manifold is also fluidly coupled to a second outlet.

At a first end of the structure, a first inlet is fluidly coupled to first ends of the first group of tubes through a first inlet manifold. A first outlet is fluidly coupled to first ends of the second group of tubes through a first outlet manifold, isolated from the first inlet manifold.

At a second end of the structure, a second inlet is fluidly coupled to second ends of the second group of tubes through a second inlet manifold. A second outlet is fluidly coupled to second ends of the first group of tubes through a second outlet manifold isolated from the second inlet manifold. In one illustrative embodiment of the present invention, the first inlet and outlet manifolds are oriented in line with one another and the second inlet and outlet manifolds are oriented in line with one another. In each case, the tubes for the outermost manifold pass through the volume of the innermost manifold.

According to a second embodiment of the present invention, a method for transfer heat from one fluid to another, includes providing a heat exchanger having a plurality of parallel tubes in a close-spaced geometrical pattern in contact with a heat-conductive medium, the plurality of parallel tubes including a first group of tubes and a second group of tubes alternating with the first group of tubes, flowing the first fluid through the first group of tubes; and flowing the second fluid through the second group of tubes. The method of the present invention is particularly advantageous where at least one of the fluids is a slurry.

BRIEF DESCRIPTION OF THE DRAWING FIGURES

DETAILED DESCRIPTION

Persons of ordinary skill in the art will realize that the following description of the present invention is illustrative only and not in any way limiting. Other embodiments of the invention will readily suggest themselves to such skilled persons.

Figure 1A:
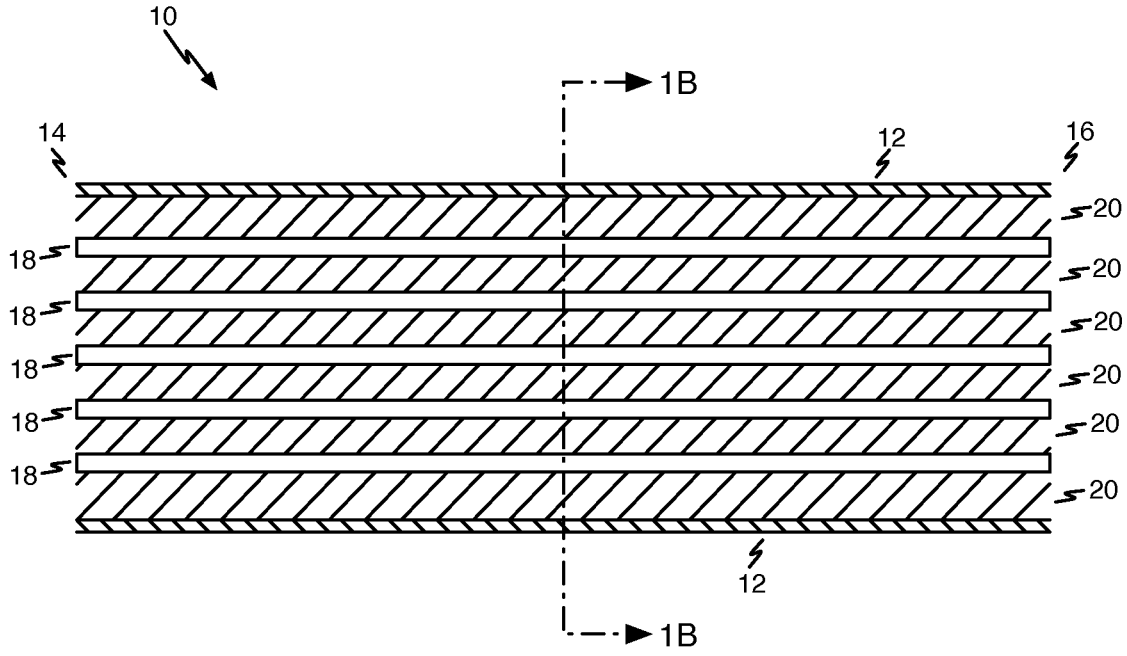
FIG. 1A is an axial cross-sectional view of an illustrative heat exchange section of a heat exchanger according to a typical embodiment of the present invention.
Figure 1B:
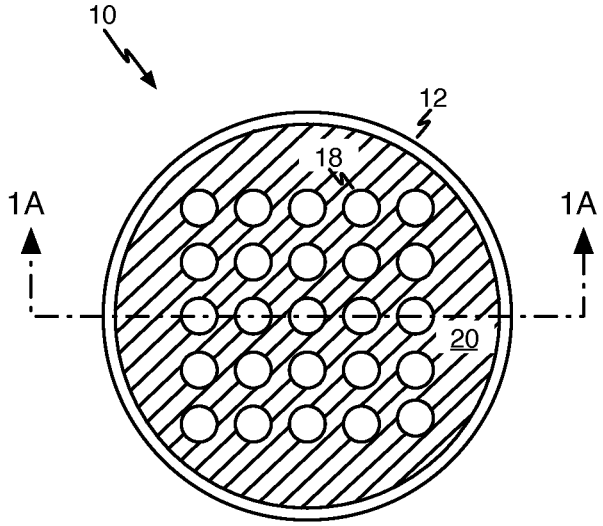
FIG. 1B is a radial cross-sectional view of the illustrative heat exchange section of a heat exchanger of FIG. 1A.

Referring now to FIGS. 1A and 1B, axial and radial cross-sectional views show an illustrative heat exchange section 10 of a heat exchanger according to a typical embodiment of the present invention. Heat exchange section 10 may include an outer shell 12 having a first end 14 and a second end 16. A plurality of tubes 18 run through the heat exchange section. The tubes 18 are arranged as two sets of parallel tubes, and are alternated in a close-spaced geometric pattern in such an arrangement and spacing in order to ensure the effective flow of heat from the fluid in one set of tubes to the fluid in the adjacent set.

Tubes 18 are held in a heat conducting-medium 20. Heat conductive medium could be a solid matrix formed, for example, from any of a variety of heat-conductive materials which can be drilled or cast, such a metals, ceramics, composites, glasses, plastics, graphite, etc. The heat-conductive medium 20 thermally couples adjacent ones of the tubes to one another.

According to various embodiments of the present invention, a multiplicity of tubes (from 2 to more than several hundred) are arranged in a parallel tube bundle similar to the bundle used in a shell-and-tube exchanger. Tube dimensions and geometries similar to those employed in shell-and-tube exchangers can be used. Tube sizing and spacing is selected to maximize heat transfer between the tubes and the heat-conductive medium. A solid matrix of a heat-conductive material such as aluminum, epoxy, ceramic, etc., is disposed around the tubes.

In other embodiments of the present invention, the heat exchange section may be manufactured by drilling or casting two or more parallel close spaced bores into a solid matrix, the matrix formed from a material chosen because it is easy to cast or drill and because it transmits heat easily, and then inserting and bonding tubes of a second material, chosen because of its chemical (non reactive) properties or because it is resistant to wear, into the holes such that a good bond is formed having a low thermal impedance which transmits heat from one tube to the other. The bond may be formed by pouring a filler material into the gap between the tubes and the holes, or by swaging (expanding) the tubes outward against the inner walls of the bores.

Figure 2:
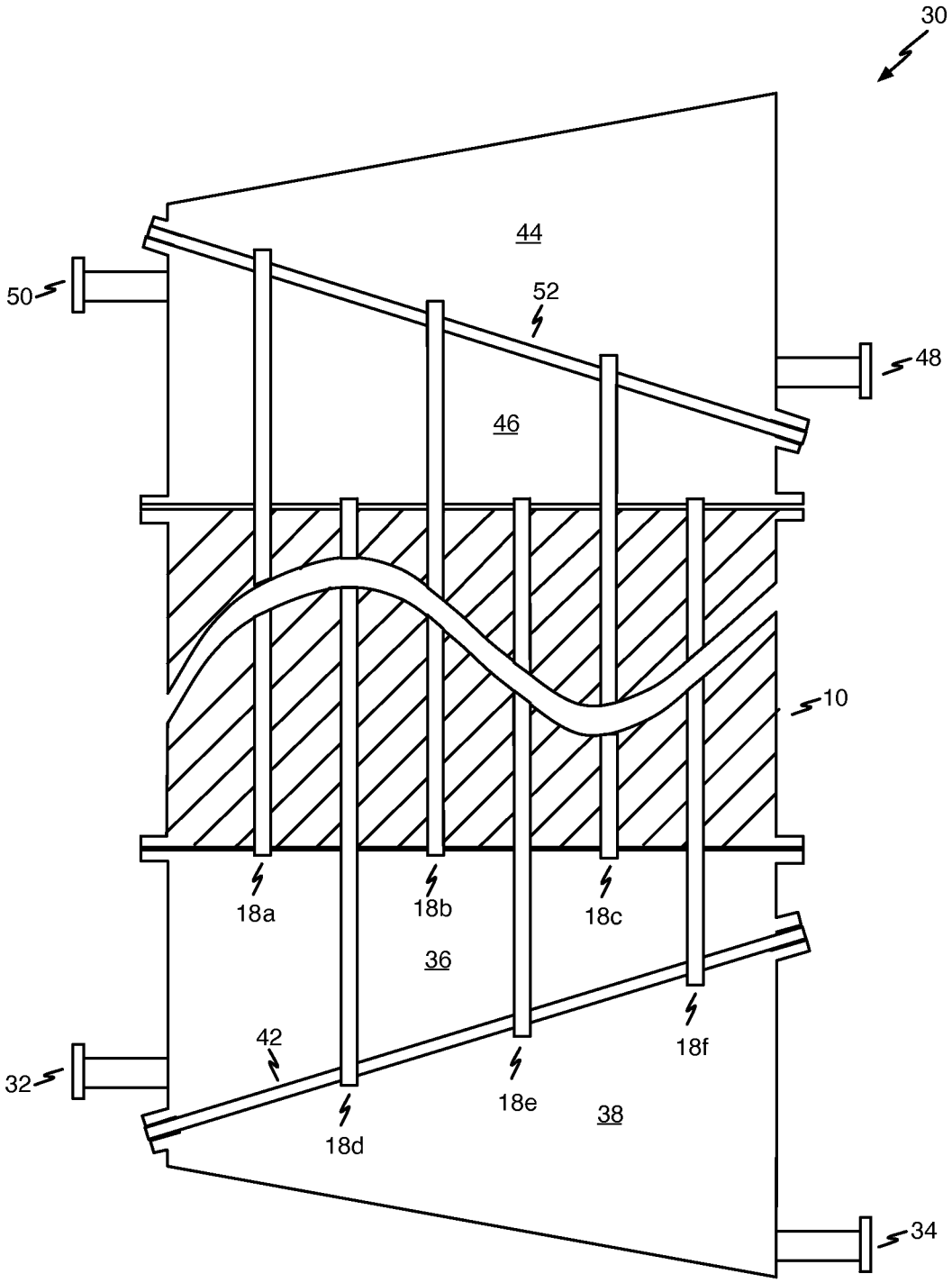
FIG. 2 is a cross-sectional diagram of an illustrative heat exchanger according to the principles of the present invention.

Referring now to FIG. 2, a cross-sectional diagram shows a heat exchanger 30 according to the present invention in which the heat exchanger section 10 depicted in FIGS. 1A and 1B coupled to a first inlet 32 and to a first outlet 34 through an inlet manifold 36 and an outlet manifold 38, respectively, at one end of an illustrative heat exchanger constructed according to the principles of the present invention.

Inlet manifold 36 is separated from outlet manifold 38 by tubesheet 42. Tubesheet 42 prevents mixing of the two sets of solutions, but allow the fluids or slurries in each set of tubes to flow in a single pass from end to end of the exchanger. Each of the inlet and outlet manifold 36 and 38 is designed to collect all of the flow from one set of tubes (or to introduce such flow into the set of tubes). The tubing diameters and manifold are designed and arranged in such a manner as to allow uniform flow of slurries (such as mineral slurries in a water-based or corrosive solution) without settling out of solids, and preventing the mixing of the flows from the two different sets of tubes, as shown in FIG. 2. In the illustrative embodiment shown in FIG. 2, the inlet manifold 36 is bolted to heat exchange section 10 at mating flanges. Similarly, tubesheet 42 and outlet manifold 38 are bolted to inlet manifold 36 at mating flanges. This construction facilitates the disassembly of heat exchanger 30 for repair or maintenance.

As shown in FIG. 2, the first ends of tubes 18*a*, 18*b*, and 18*c* communicate with inlet manifold 36 and the first ends of tubes 18*d*, 18*e*, and 18*f*, alternating with tubes 18*a*, 18*b*, and 18*c*, communicate with outlet manifold 38. At the other end of heat exchange section 10, the second ends of tubes 18*a*, 18*b*, and 18*c* communicate with an outlet manifold 44 and the second ends of tubes 18*d*, 18*e*, and 18*f* communicate with an inlet manifold 46. Outlet manifold 44 communicates with outlet 48 and inlet manifold 46 communicates with inlet 50. Inlet manifold 46 is separated from outlet manifold 44 by tubesheet 52. Tubesheet 52 prevents mixing of the two sets of solutions. Inlet manifold 46, outlet manifold 44, and tubesheet 52 may be bolted to each other and to the second end of heat exchanger section 10 at flanges to facilitate the disassembly of heat exchanger 30 for repair or maintenance. While FIG. 2 shows heat exchanger 30 in a vertical orientation, persons of ordinary skill in the art will appreciate that a horizontal or angled orientation may be employed.

As described above, the ends of heat exchanger 30 are configured in such a manner that solution or slurries (fluid) will maintain a simple and uniform flowpath. In the embodiment just described, the flow in a first direction will enter through a header pipe into an inlet manifold at the first end of the heat exchanger, through the first set of tubes in the heat exchange section, through an outlet manifold at the second end of the heat exchange section for collecting all the fluid and distributing it to a header pipe in the side of the manifold. The flow in a second direction will enter through a header pipe into an inlet manifold on the second end of the heat exchanger, through the second set of tubes in the heat exchange section, through an outlet manifold at the first end of the heat exchange section for collecting all the fluid and distributing it to a header pipe in the side of the manifold. The seals between the tubes and the tubesheets 42 and 52 may be made using compression fittings or O-ring seals such that the manifold assemblies and tubesheets can be easily removed for servicing. Persons of ordinary skill in the art will appreciate that the inlet and outlet functions of one of the sets of manifolds could be reversed according to another embodiment of the present invention such that a concurrent flow arrangement instead of a counterflow arrangement is realized.

Persons of ordinary skill in the art will appreciate that the ends of the first and seconds sets of tubes may be coupled to one another using structures other than the manifolds described above. As a non-limiting example, the ends of the tubes may be merged with one another using tubing or piping connections.

In a method according to the present invention, heat may be transferred in a tubular heat exchanger from the flowing contents of the first set of tubes 18*a*, 18*b*, and 18*c* to the flowing contents of the second set of tubes 18*d*, 18*e*, and 18*f* by arranging for the flow to occur as a single pass from one end of the exchanger to the other, either co-current (flowing contents in both sets of tubes enter at the same end of the exchanger) or countercurrent in which a first solution or slurry enters the first end 40 of the heat exchanger 30 and exits at the second end, while a second solution or slurry enters the second end and exits at first end 40.

In operation, the slurry to be heated or cooled is run in a first set of the tubes, and a similar slurry with a different heating profile is run in a second set of the tubes, each tube in the second set adjacent to at least one of the tubes in the first set of tubes. The present invention is particularly useful when the two slurries are run in opposite (countercurrent) directions, thus heating one slurry while cooling the other. In a typical system it is possible to heat a slurry in such a countercurrent configuration from room temperature to a very high temperature (e.g., 200° C.) against a returning heated slurry which is cooled from the high temperature to room temperature. The temperature approach of the two slurries can be as close as a few degrees C., so that even though the slurry at the high-temperature end may be at, for example, 200° C., only enough heat needs to be added to raise the slurry a few degrees C.

The size and number of tubes can vary over a wide range similar to the variation which is already practiced in the fabrication of shell and tube exchangers or tubular exchangers. Tubing diameter can range from smaller than ½ inches to 3 inches or more depending on the type of slurry or process fluid and the cost tradeoffs in building and servicing the exchanger. Similarly, number of tubes can vary from two tubes to a very large number (similar to some shell and tube exchangers that have more than 1,000 tubes), depending on the total flowrate of the liquid or slurry to be processed.

The spacing of tubes is more important in the present invention than in a typical shell and tube exchanger, and is based on mathematical modeling of heat flow from tubes in one set to the alternating (intercalated) tubes in the second set. If the tubes are too far apart, then the heat leaving the tube and entering the heat transfer matrix can flow parallel to the tube axis and enter either the same tube or the adjacent tube at a non-perpendicular point. This results in "smearing" of the heat transfer effect. In the best geometry, heat flows directly out of one tube and into the adjacent tube using the shortest flowpath which is a straight line flowpath perpendicular to the tube axes. This requires close tube spacing, but if the tubes are too close, then construction of the exchanger is difficult and expensive. The best matrix is not necessarily made from the most heat-conductive material, but rather from a material that maximizes perpendicular heat flow within the tube spacing constraints. In practice for most materials and mediums, the center-to-center spacing of the tubes may be between about ⅛ inch and about ¾ inch greater than the tube diameter.

If the heat exchanger is designed properly, most of the heat flows perpendicular to the tube axes. This results in the heat exchanger having a very large number, almost an infinite number, of theoretical heat exchange stages. With this design it is possible to get a very close temperature approach from the liquid or slurry flowing in one set of tubes to the liquid or slurry flowing in the other set of tubes. This is one of the distinguishing features of the present invention. In a shell and tube exchanger with fluid in the shell, the number of theoretical stages is dictated by the effectiveness of the flowpath in the shell and is usually a small number. As an extreme example, heat can be extracted as steam in the shell from a slurry in the tubes, but in this case there is only one theoretical stage of transfer regardless of the length of the exchanger, since the steam in the shell is all at the same temperature. The effect of a low number of theoretical stages is that the exchanger must be much longer to achieve the same temperature profile as a heat exchanger with a large number of theoretical stages. In shell and tube exchanger configurations processing slurries, the extracted heat must be sent to a second exchanger where the heat is then transferred to the other slurry. The present invention allows the efficient design of an exchanger for the extraction and simultaneous transfer of the heat when the flowing fluid is a slurry.

In one embodiment of the present invention, stainless steel tubes with an OD of ⅝ inches and an ID of ½ inches were placed in a block-centered matrix ⅞ inches on centers, and a solid aluminum matrix was cast around them. The thickness of the "shell" matrix surrounding the outer row of tubes was varied, and it was determined that the thickness in this area should be approximately half the tube diameter. Although small-diameter tubes are very effective at transferring heat, some slurries (because they possess much higher viscosities) need to be processed through much larger tubes. Also for process plants with very high liquid or slurry flowrates, larger tubes may be selected because the capital and maintenance costs of the exchanger increase as the tubing diameter decreases.

During the development process of the present invention, different heat exchangers were formed by casting aluminum, zinc and copper matrices around ⅝" O.D., ½" I.D. stainless steel tubes on about ⅞" centers. Using water flowing counter currently against water, a heat transfer coefficient (from the liquid in one set of tubes to the liquid in the other) of more than 400 BTU per hour per sq. ft. per ° F. was achieved. Shell and tube exchangers typically achieve 300 BTU per hour per sq. ft. per ° F. for the transfer of heat from the liquid in the tubes to the liquid in the shell.

Figure 3:
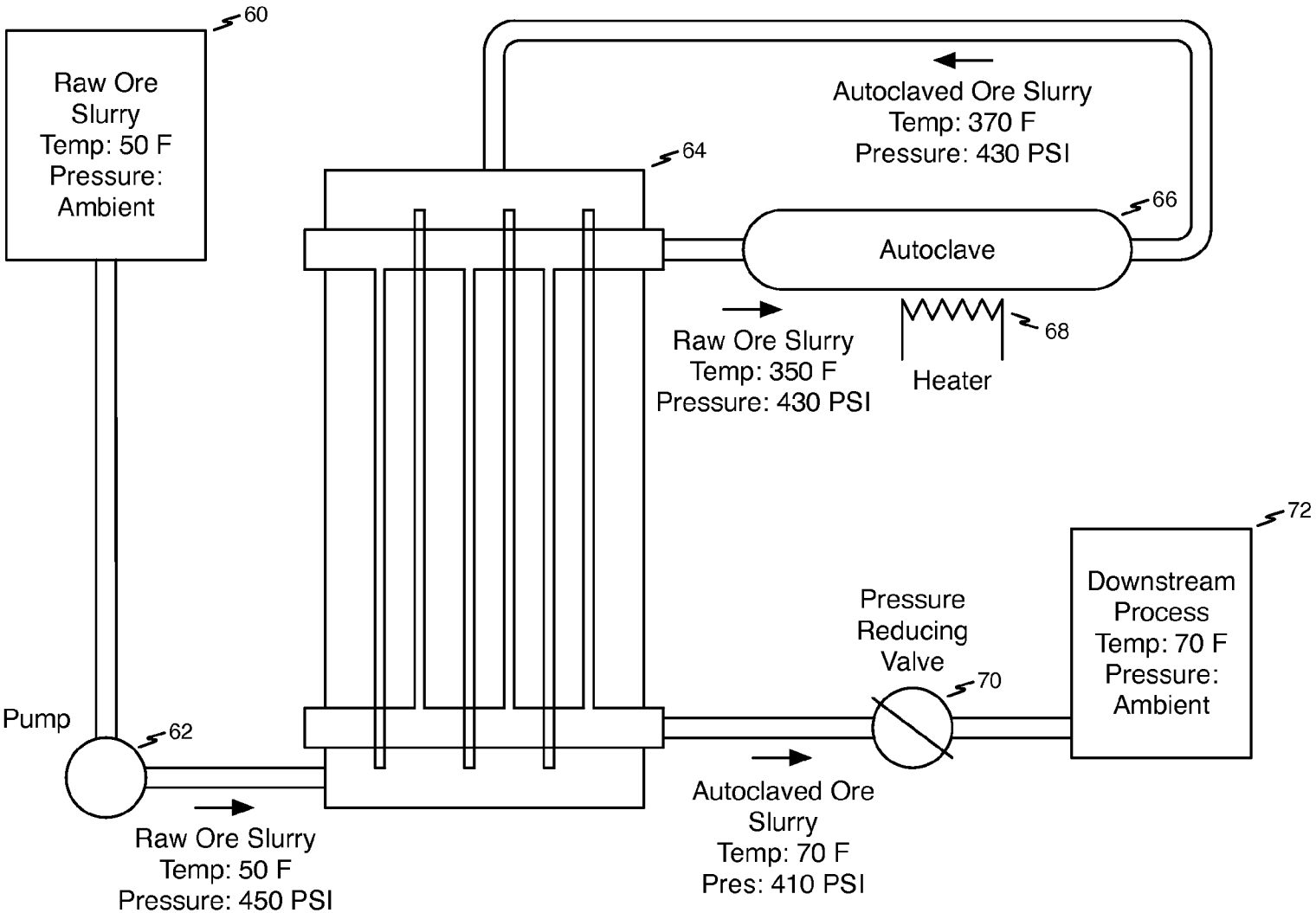
FIG. 3 is a diagram of a process employing an illustrative heat exchanger according to the principles of the present invention.

Referring now to FIG. 3, a diagram shows an illustrative process employing an illustrative heat exchanger according to the principles of the present invention. The process starts at reference numeral 60 using an ore slurry at 50° F. and ambient pressure. Pump 62 raises the pressure of the slurry to 450 PSI. The slurry is then pumped upwardly through the heat exchanger 64, in which it receives heat from slurry traveling downwardly through heat exchanger 64. At the output of the heat exchanger 64, the temperature of the slurry is 350° F. at a pressure of 430 PSI. The slurry travels into autoclave 66 having a heater 68 that raises its temperature 20° F. to 370° F. where it is processed. The slurry then travels back down through the heat exchanger 64 in which it transfers heat to the counterflowing slurry moving upwardly through heat exchanger 64. The slurry exits the bottom of heat exchanger 64 at a temperature of 70° F. and a pressure of 410 PSI. The slurry then passes through pressure-reducing valve 70 and, at reference numeral 72 passes to downstream processes at a temperature of 70° F. at ambient pressure.

The present invention satisfies a long felt and unsatisfied need for equipment that can effectively and efficiently transfer heat from one mineral ore slurry to another, and thus represents a major advance over existing prior-art heat exchangers that have not met this need.

While the present invention is disclosed in the context of heat exchange in mineral slurries in the mining industry, persons of ordinary skill in the art will recognize that it has much broader uses than mineral slurries, such as in various processes employed in the pharmaceutical and chemical industries that currently use other types of exchangers. The heat exchangers presently used in these industries have complicated geometries, sharp corners, and passage configurations that are difficult to clean.

A simple configuration in accordance with the present invention in which all fluids moving in either direction move through round, straight, non-fouling tubes which are easily accessible, and easily cleaned solves the problems of the prior art. The present invention provides a highly efficient, hitherto unavailable heat exchanger that significantly reduces maintenance and operating costs.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A method for processing a mineral ore slurry comprising:

passing an input stream of mineral ore slurry at ambient temperature and pressure through a pump to create a stream of mineral ore slurry at a processing pressure;

passing the input stream of mineral ore slurry at the processing pressure in a first direction through a solid matrix heat exchanger to transfer heat to raise the temperature of the input stream of mineral ore slurry;

adding additional heat to the input stream of mineral ore slurry exiting the solid matrix heat exchanger at the processing pressure sufficient to raise the temperature of the input stream of mineral ore slurry to a processing temperature, and reacting it as the process requires, to create a processed output stream of mineral ore slurry;

flowing the processed output stream of mineral ore slurry in a second direction opposite the first direction through the countercurrent solid matrix heat exchanger to transfer heat from the processed output stream of mineral ore slurry to the input stream of mineral ore slurry at the processing pressure; and reducing the pressure of the output stream of mineral ore slurry to create an ambient-pressure output stream of mineral ore slurry.

2. The method of claim 1 wherein the input stream of mineral ore slurry and the processed output stream of mineral ore slurry are settling slurries.

* * * * *